US005430804A

United States Patent [19]

Wijnker

[11] Patent Number: 5,430,804

[45] Date of Patent: Jul. 4, 1995

[54] LOUDSPEAKER WITH A COATED VOICE COIL

[75] Inventor: Eddy L. L. Wijnker, Hoorn, Netherlands

[73] Assignee: Laine B.V., Hoorn, Netherlands

[21] Appl. No.: 64,048

[22] PCT Filed: Nov. 13, 1991

[86] PCT No.: PCT/NL91/00229

§ 371 Date: Sep. 7, 1993

§ 102(e) Date: Sep. 7, 1993

[87] PCT Pub. No.: WO92/09180

PCT Pub. Date: May 29, 1992

[30] Foreign Application Priority Data

Nov. 16, 1990 [NL] Netherlands ..... 9002510

[51] Int. Cl.[6] ..... H04R 25/00

[52] U.S. Cl. ..... 381/194; 381/199

[58] Field of Search ..... 381/199, 194, 204, 192

[56] References Cited

U.S. PATENT DOCUMENTS

| | | | |
|---|---|---|---|
| 3,935,402 | 1/1976 | Gersten | 179/115.5 |
| 4,088,847 | 5/1978 | Yukimoto et al. | 381/194 |
| 4,479,035 | 10/1984 | Philippbar | 179/115.5 |

FOREIGN PATENT DOCUMENTS

| | | | |
|---|---|---|---|
| 0112559 | 7/1984 | European Pat. Off. . | |
| 0200257A1 | 11/1986 | European Pat. Off. | H04R 9/00 |
| 869648 | 3/1942 | France | H04R 9/02 |
| 56-79600A | 6/1981 | Japan | H04R 9/04 |
| 59-138199A | 8/1984 | Japan | H04R 9/04 |
| 63-279696A | 11/1988 | Japan | H04Q 11/04 |
| 63-279697A | 11/1988 | Japan | H04R 9/04 |
| 8501166 | 11/1986 | Netherlands | H04R 7/06 |
| 9002190 | 10/1990 | Netherlands | H04R 9/02 |
| 2194707 | 3/1986 | United Kingdom | H04R 9/02 |

*Primary Examiner*—Curtis Kuntz
*Assistant Examiner*—Sinh Tran
*Attorney, Agent, or Firm*—Willian Brinks Hofer Gilson & Lione

[57] ABSTRACT

A loudspeaker is disclosed which includes a magnet for generating a magnetic field, an element disposed for resilient movement to generate sound waves, and an electrical conductor operatively connected to the element and disposed within the magnetic field such that the element moves responsive to current within the electrical conductor. The conductor having a corrosion and oxidation resistant coating such that the electrical conductor is sealed from corrosive and oxidizing gas. The corrosion and oxidation resistant coating has a mass sufficiently small such that sensitivity of the loudspeaker does not measureably decrease.

8 Claims, 4 Drawing Sheets

LOUDSPEAKER WITH A COATED VOICE COIL

BACKGROUND OF THE INVENTION

The invention relates to a a loudspeaker comprising:

a magnet unit which generates a magnetic field;

an element suspended for resilient movement round a stable rest position, such as a diaphragm, a cone, a dome or other element suitable for radiating sound with selected properties; and an electrical conductor, for instance a speech coil, connected to that movable element and having current feed terminals, which conductor is placed in the said magnetic field such that when current is passed through this conductor a force is exerted on the movable element which imparts to the element a displacement from its rest position;

the conductor being covered by a corrosion and oxidation resistant coating such that entry of the gases stimulating corrosion or oxidation of the conductor, particularly oxygen, is prevented.

Such a loudspeaker is generally known.

E.g. from JP-A-59-138 199 an electro dynamic loudspeaker is known, in which all faces of exposed parts of the diaphragm, the preferable support section, a coil bobbin, the voice coil and adhesive of the coupling section are covered with a synthetic resin layer. In connection with this prior art technique it should be noted that in this prior art loudspeaker also parts not subjected to high temperatures are coated. Such coating only contributes to the weight of the movable structure, affecting the sensitivity of the loudspeaker.

From U.S. Pat. No. 3,935,402 a loudspeaker voice coil arrangement is known in which the aluminum voice coil wire is provided with a flexible anodized coating. Anodization does generally not provide a sufficient insulating value and is susceptible to damage during the winding of the voice coil.

EP-A-0 112 559 discloses a loudspeaker having a cilindrical voice coil specifically adapted for automatic production. The flexible feed terminals are designed as flat strip conductors connected with a synthetic resin support strip. The exposed faces of the conductor strips are covered with a polyimide-coating foil. The voice coil is manufactured according to general prior art standards.

U.S. Pat. No. 4,479,035 discloses a loudspeaker assembly having a voice coil bobbin formed out of a high temperature ceramic material. The helical transducer windings are formed of a molybdenum-mangane metallization. Specifically under high temperature conditions these windings may be susceptible to oxidation or, in general, corrosion.

It is a purpose of the invention to provide a loudspeaker, in which the conductor, generally consisting of aluminum, is not susceptible to oxidation and corrosion, not even at the highly increased temperatures that can occur in a loudspeaker. It is furthermore a purpose of the invention to design the loudspeaker in a way such that the sensitivity of the loudspeaker is not to any substantial degree decreased, due to the fact that the mass added by the protected measures to the movable parts, is negligible.

SUMMARY OF THE INVENTION

With a view of these purposes the loudspeaker according to the invention is characterized in that the coating comprises a ceramic material layer having a thickness in the order of magnitude of 0.1 μm. In a specific embodiment the loudspeaker is characterized in that the coating comprises an electrically conducting layer, which is electrically insulated from the conductor by the ceramic material layer. In this embodiment the oxygen is even more prevented from oxidizing and therefor degrading the conductor.

Particularly the electrically conducting layer may consist of metal, e.g. a precious metal.

BRIEF DESCRIPTION OF THE DRAWINGS

The invention will now be elucidated with reference to the annexed drawings, in which.

DETAILED DESCRIPTION OF THE PREFERRED EMBODIMENTS

Figure 1:
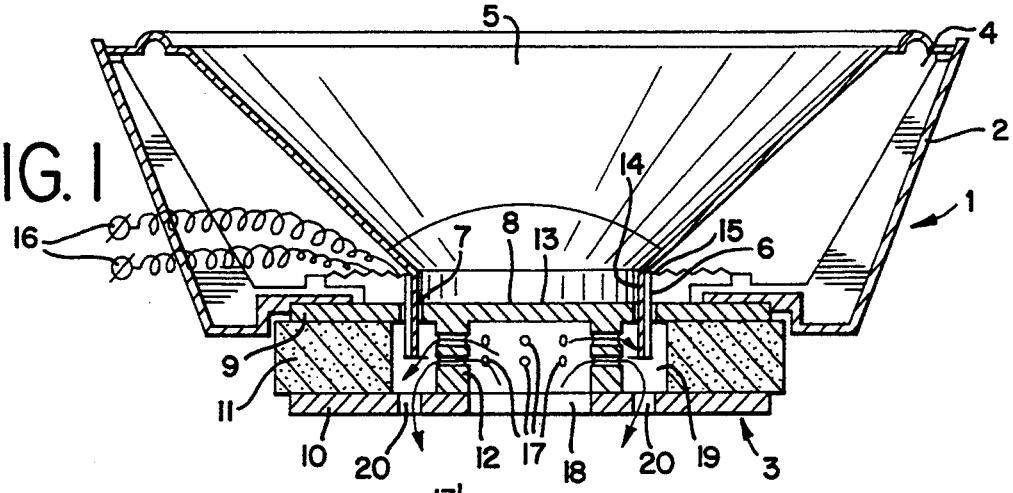
FIG. 1 shows a cross section through a cone loudspeaker according to the invention in a first embodiment.

FIG. 1 shows a loudspeaker 1 of the electrodynamic type comprising a framework 2, a magnet unit 3 coupled thereto, a cone 5 connected to the framework via a pliant suspension rim 4 and a cylindrical speech coil 6. The speech coil 6 is axially movable in an annular air gap 7 in which a strong magnetic field prevails. The air gap is bounded on the inner side by a central pole piece 8 and an annular pole piece 9 extending therearound at a distance. A magnetic closing plate 10 is situated on the underside of the central pole piece 8. Arranged between this closing plate 10 and the annular pole piece 9 is an annular permanent magnet 11.

As can be seen in FIG. 1, the central pole piece 8 comprises a cylindrical central portion 12 and a top plate 13 of greater diameter. The annular pole piece 9 has a smaller inner diameter than the permanent magnet 11. This configuration ensures a strong and concentrated magnetic filed in the air gap 7.

The speech coil 7 is of known type and comprises a tube 14 serving as a speech coil carrier and a conductor 15 wound thereon in coil-like manner.

It will be apparent that when current is sent through the conductor 15 via current feed terminals 16 the speech coil 6 will be displaced counter to the resilience of the pliant suspension rim 4 through interaction with the magnetic field.

The loudspeaker 1 is provided with cooling means for cooling the conductor 15. For this purpose the cylindrical centre portion 12 of the central pole piece 8 is provided with annular rows of perforations 17 in the wall, wherein the opening 18 present on the bottom serves for supplying gas, for instance air, under pressure, which gas can enter the cylindrical space 19 through the openings 17, can there serve to cool the conductor 15 and can subsequently leave the space 19 again via openings 20.

Also achieved with this configuration and also the configurations according to FIGS. 2 and 3 to be described hereinafter is that the permanent magnet 11 is cooled. This has the particular advantage that when neodymium is used as magnet material the field strength in the air gap is maintained even in the case of prolonged high electrical load of the loudspeaker 1.

Figure 2:
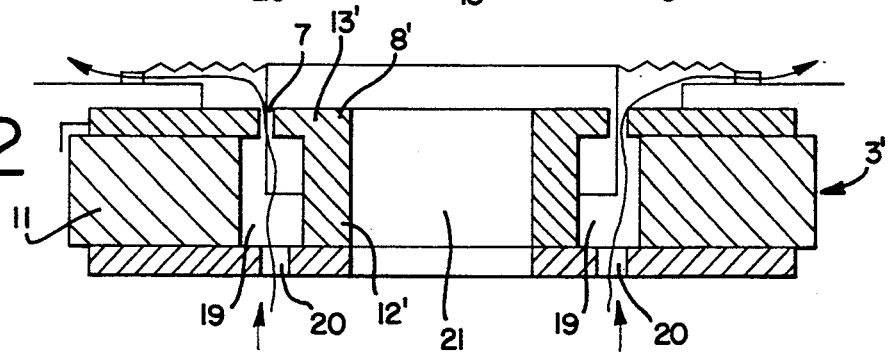
FIG. 2 is a view corresponding with FIG. 1 of a detail of a second embodiment.
Figure 3:
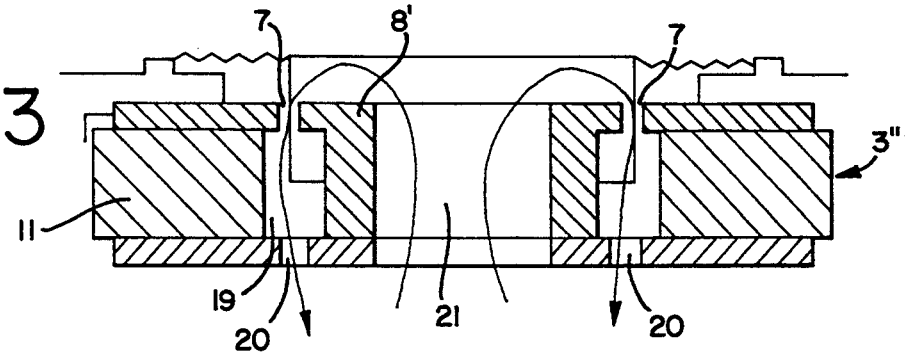
FIG. 3 is a view corresponding with FIG. 2 of a third embodiment.

FIG. 2 shows a second embodiment. Air enters here via the openings 20, passes through the space 19 and leaves the magnet unit 3' via the air gap 7, which ensures an effective cooling of the conductor 15. The central pole piece according to FIG. 2 differs from that of FIG. 1 and is therefore designated 8'. The associated cylindrical central portion 12' has no perforations. The top plate 13' is an annular widening at the top.

The third embodiment according to FIG. 3 differs from FIG. 2 in that the through-hole 21 of the central pole piece 8' is used here for supplying air from below which enters the air gap 7 from the top, brushes along the conductor 15, thus cooling it, and once again leaves the magnet unit 3" via the space 19 and the holes 20.

It will otherwise be apparent that combinations of the mentioned embodiment details are also possible. The air flows are also designated in the figures only very generally and for purposes of orientation.

Figure 4:
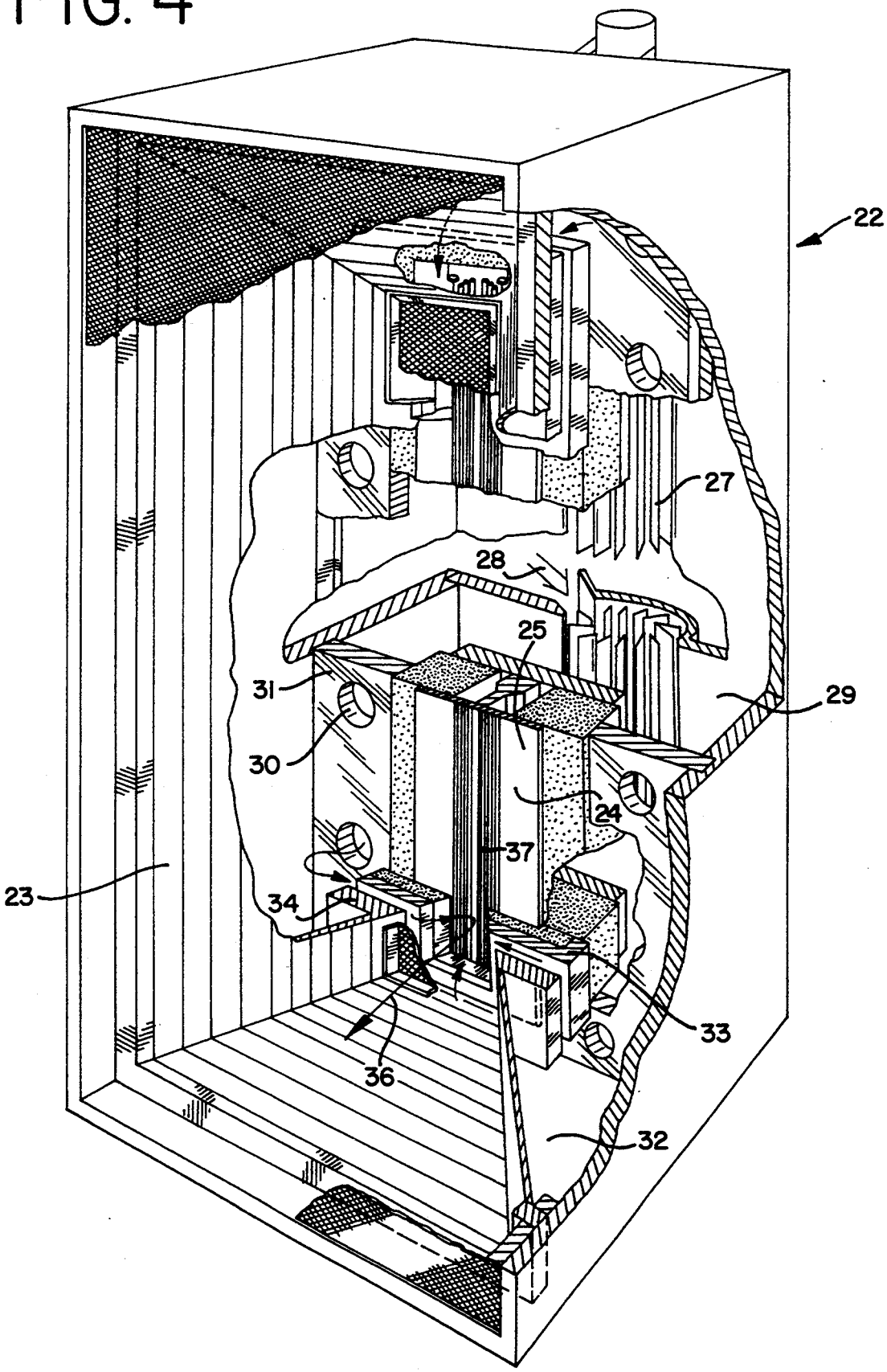
FIG. 4 is a partly broken away perspective view of a ribbon loudspeaker with horn loading accommodated in a cabinet.

FIG. 4 shows a loudspeaker cabinet 22 in which is situated a ribbon loudspeaker to be briefly described hereinbelow. This ribbon loudspeaker is of per se known type and is described for instance in the Netherlands patent application 85.01166.

The cabinet bears a horn 23 which debouches on the front side and in the throat of which is situated a diaphragm 24. This diaphragm is clamped into a frame 25 incorporated in the magnet unit 26 to be further described with reference to FIG. 6.

The cabinet bears at its rear a fan 27 which draws in ambient air 28 and blows it into the rear space 29 of cabinet 22. This air is blown via perforations 30 in a partition 31 into the forward space 32 of the cabinet 22. Available between the front plate 33 of the magnet unit 26 and the rear plate 34 of the horn 23 is a free gap through which the air can escape into the forward space.

The magnet unit 26 is fixed to the partition 31 while the horn 23 is fixed on the side of the mouth to the cabinet 22, thus on the front thereof.

Figure 6:
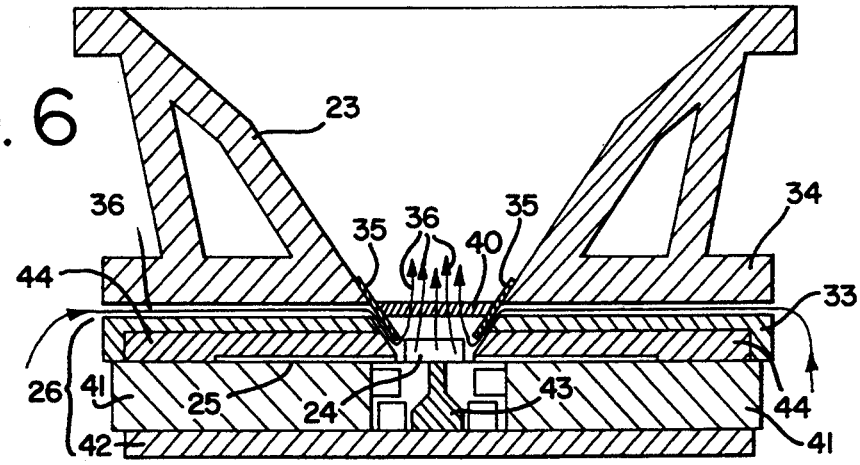
FIG. 6 shows the cross section V—V of the loudspeaker unit with loading horn of FIG. 5.
Figure 5:
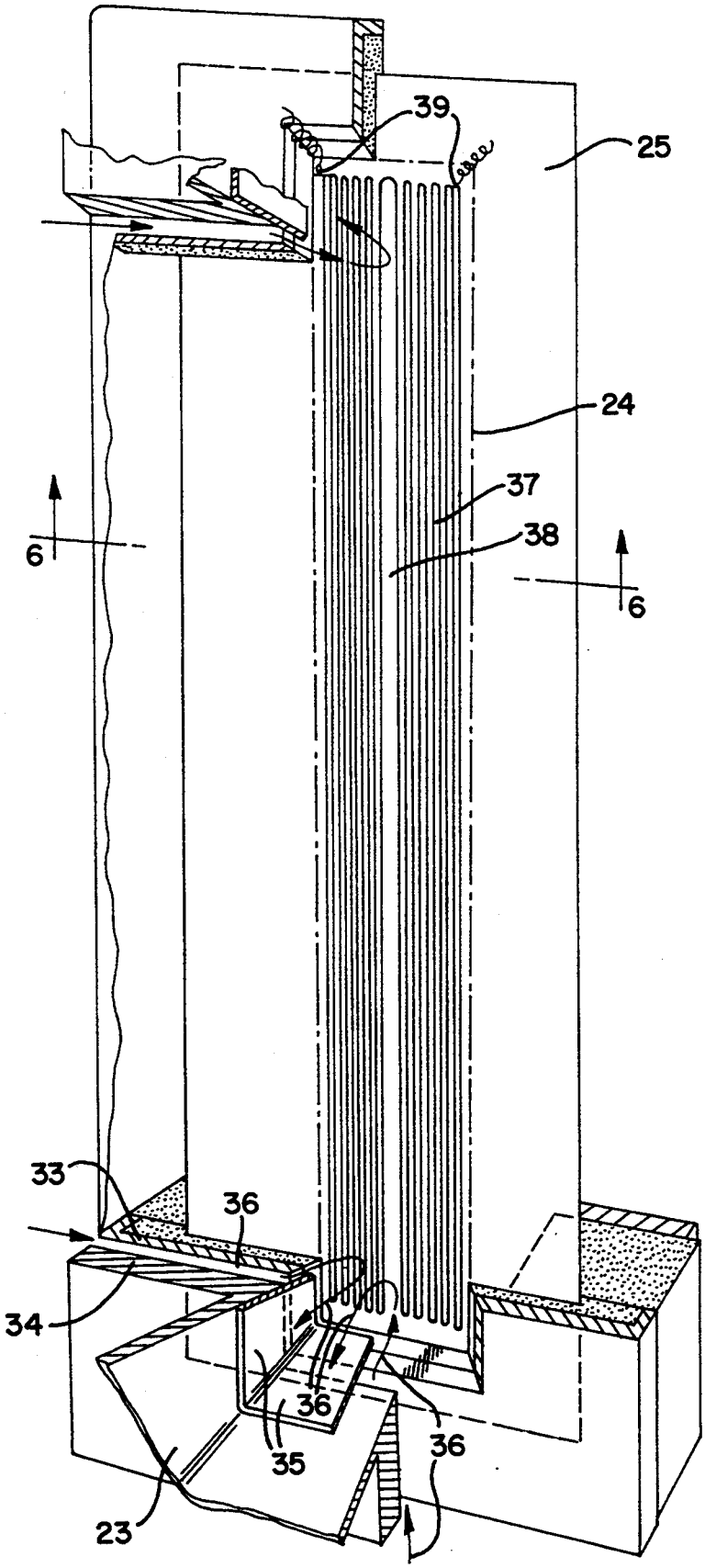
FIG. 5 shows a detail of the loudspeaker of FIG. 4.

As shown clearly in FIGS. 5 and 6 particularly, the horn has plates 35 on the side of the throat, therefore in the region of the diaphragm 24, which plates form a extension of the inner walls of horn 23. These plates 35 extend over the outflow openings of the air gaps 36, i.e. the mentioned free spaces between the magnet unit 26 and the horn 23. Thus achieved in the manner shown in FIGS. 4, 5 and 6 is that the diagram 24 is cooled from the long sides of both sides by the air flows brushing past which are designated with 36. Situated in the central zone of the diaphragm 24 is a spiral-like conductor 37 which has a free central region 38 as a result of its spiral shape. An effective cooling of the conductor takes place due to the air flows moving in opposing directions from the sides, and these air flows leave the diaphragm in transverse direction thereof through the horn 23.

The short sides of the diaphragm are also subjected to such an air cooling, which is of particular importance for the current feed terminals 39 shown in FIG. 5.

The diaphragm 24 is covered by a substantially acoustically transparent plate 40 arranged at some distance therefrom in the horn. This plate can consist of mesh or foamed material or the like.

For the sake of completeness, the magnet unit 26 will also be discussed briefly with specific reference to FIG. 6. This comprises two elongate permanent magnets 41 consisting of neodymium. Situated at the bottom is a magnetic closing plate 42 which carries a central pole piece 43. At the top each of the permanent magnets 41 carries a pole piece 44 having a tapering form similar to the horn 23. Due to the placing of the diaphragm 24 as shown in FIG. 6 and in particular the conductor 37 arranged thereon is achieved that this conductor co-acts as well as possible with the magnetic field between the pole piece 43 and the pole pieces 44.

FIG. 4 shows the diaphragm 24 on which the aluminum conductor 37 is arranged. Applied over the conductor 37 is a coating 101 of a polyimide, particularly polyetherimide, whereby the conductor 37 is wholly protected against the influence of oxygen from the surrounding air.

Figure 8:
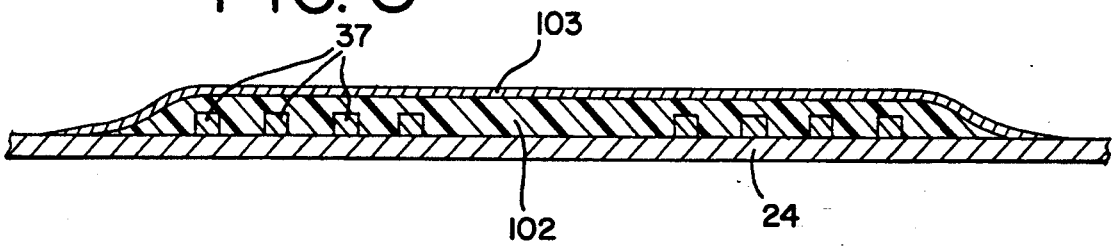
FIG. 8 is a view corresponding with FIG. 7 of a variant.

FIG. 8 shows a variant in which the conductor 37 is covered by a coating 102 of a ceramic material over which is applied a coating 103 of gold.

With respect to the applying of the said coatings it is noted that the application of a polyimide can take place by dissolving the polyimide in a solvent, applying the solution over the conductor and allowing the solvent to evaporate. Application of a ceramic coating can for instance take place by sputtering. The applying the coating 103 according to FIG. 8 can for instance take place by vapour deposition.

It is self-evident that it must be ensured that the coating layer performs its function correctly in all conditions. The layer must therefore be completely sealed and integral in all conditions. The insulating layer 102 must also be applied such that the aluminum conductor 37 cannot come into electrical contact with the metal coating 103.

Figure 7:
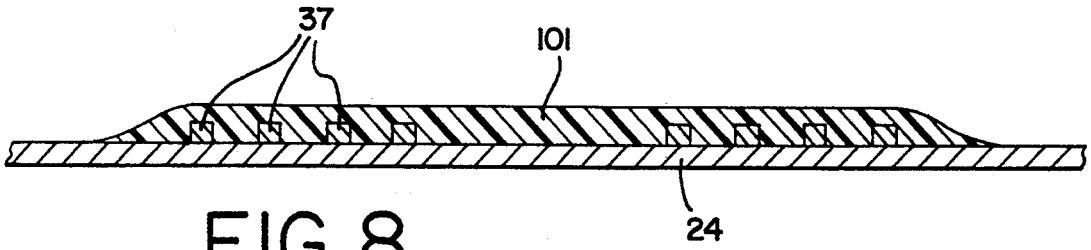
FIG. 7 shows the section VII—VII of FIG. 5.
Figure 9:
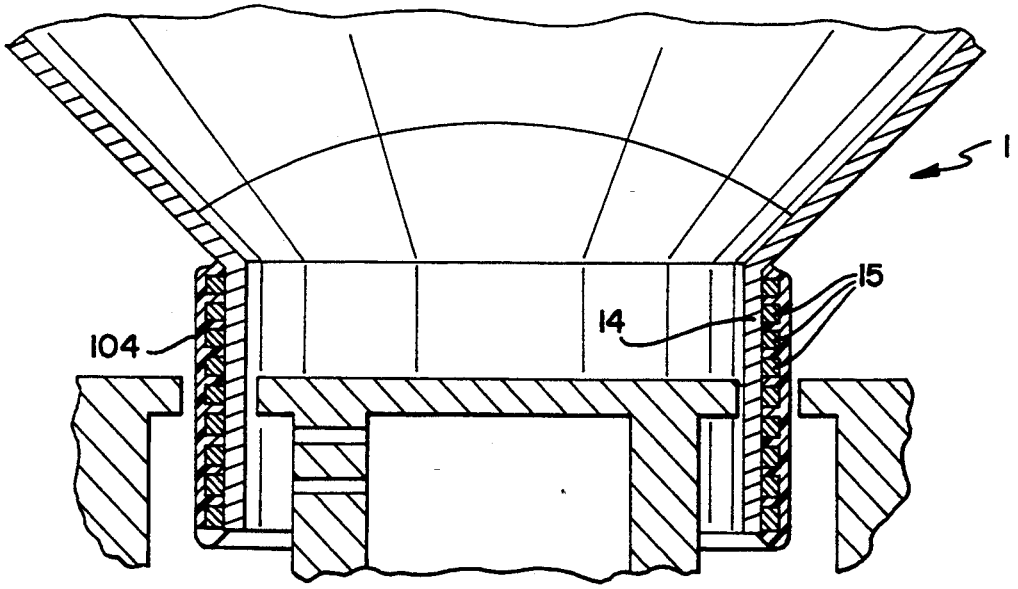
FIG. 9 shows a detail of the loudspeaker according to FIG. 1 on enlarged scale.

Finally, FIG. 9 shows a detail of the loudspeaker of FIG. 1 on enlarged scale. In this loudspeaker 1 the speech coil 15 is carried by the cylindrical speech coil carrier 14. As according to FIG. 7, the aluminum conductor 15 is covered by a coating 104.

What is claimed is:

1. A loudspeaker comprising:

a magnet unit which generates a magnetic field;

an element suspended for resilient movement round a stable rest position suitable for radiating sound with selected properties;

an electrical conductor connected to the element and having current feed terminals; the conductor being placed in the same magnetic field such that when current is passed through the conductor a force is exerted on the element which imparts to the element a displacement from its rest position;

the conductor being covered by a corrosion and oxidation resistant coating such that entry of gases stimulating corrosion or oxidation of the conductor is prevented;

and wherein the coating includes a ceramic material layer having a thickness in the order of magnitude of 0.1 μm.

2. The loudspeaker as claimed in claim 1 wherein the coating further includes an electrically conducting layer electrically insulated from the conductor by the ceramic material layer.

3. The loudspeaker as claimed in claim 2 wherein the electrically conducting layer comprises a metal.

4. The loudspeaker as claimed in claim 3 wherein the metal is a gold.

5. The loudspeaker as claimed in claim 1 wherein the element is one of a cone diaphragm and a dome diaphragm.

6. The loudspeaker as claimed in claim 1 wherein the electrical conductor is a speech coil.

7. A loudspeaker comprising:

a magnet for generating magnetic field;

an element disposed for resilient movement to generate sound waves;

an electrical conductor operatively connected to the element and disposed within the magnetic field such that the element moves responsive to current within the electrical conductor;

a corrosion and oxidation resistant coating disposed on the electrical conductor such that the electrical conductor is sealed from corrosive and oxidizing gas; the corrosion and oxidation resistant coating having a mass sufficiently small such that sensitivity of the loudspeaker does not measurably decrease; and an electrically conducting layer disposed on the corrosion and oxidation resistant coating such that the corrosion and oxidation resistant coating is disposed between the electrical conductor and the electrically conducting layer.

8. A loudspeaker as defined in claim 7 wherein the corrosion and oxidation resistant coating has a thickness of about 0.1 $\mu$m.

* * * * *